US006054020A

United States Patent [19]

Goulet et al.

[11] Patent Number: 6,054,020

[45] Date of Patent: Apr. 25, 2000

[54] SOFT ABSORBENT TISSUE PRODUCTS HAVING DELAYED MOISTURE PENETRATION

[75] Inventors: Mike Thomas Goulet, Appleton; Dale Alan Burghardt, Butte des Morts; Duane Gerard Krzysik, Appleton, all of Wis.

[73] Assignee: Kimberly-Clark Worldwide, Inc., Neenah, Wis.

[21] Appl. No.: 09/012,588

[22] Filed: Jan. 23, 1998

[51] Int. Cl.[7] ..... D21H 21/22

[52] U.S. Cl. ..... 162/112; 162/109; 162/127; 162/135

[58] Field of Search ..... 162/109, 112, 162/127, 135

[56] References Cited

U.S. PATENT DOCUMENTS

| | | | |
|---|---|---|---|
| 3,818,533 | 6/1974 | Scheuer | 15/104.93 |
| 4,046,930 | 9/1977 | Johnson et al. | 427/387 |
| 4,349,610 | 9/1982 | Parker | 428/447 |
| 4,359,545 | 11/1982 | Ona et al. | 524/262 |
| 4,406,738 | 9/1983 | Fink et al. | 162/124 |
| 4,408,996 | 10/1983 | Baldwin | 8/490 |
| 4,414,268 | 11/1983 | Baldwin | 428/289 |
| 4,425,372 | 1/1984 | Baldwin | 427/2 |
| 4,613,447 | 9/1986 | Hara et al. | 252/91 |
| 4,680,366 | 7/1987 | Tanaka et al. | 528/27 |
| 4,789,564 | 12/1988 | Kanner et al. | 427/255.6 |
| 4,950,545 | 8/1990 | Walter et al. | 428/446 |
| 5,059,282 | 10/1991 | Ampulski et al. | 162/111 |
| 5,164,046 | 11/1992 | Ampulski et al. | 162/111 |
| 5,215,626 | 6/1993 | Ampulski et al. | 162/112 |
| 5,227,242 | 7/1993 | Walter et al. | 428/446 |
| 5,240,562 | 8/1993 | Phan et al. | 162/158 |
| 5,246,545 | 9/1993 | Ampulski et al. | 162/112 |
| 5,246,546 | 9/1993 | Ampulski | 162/112 |
| 5,281,658 | 1/1994 | Ona et al. | 524/838 |
| 5,302,657 | 4/1994 | Huhn et al. | 524/588 |
| 5,373,637 | 12/1994 | Harris et al. | 29/898.12 |
| 5,385,643 | 1/1995 | Ampulski | 162/135 |
| 5,389,204 | 2/1995 | Ampulski | 162/135 |
| 5,389,504 | 2/1995 | Ling et al. | 430/506 |
| 5,409,620 | 4/1995 | Kosal et al. | 252/8.6 |
| 5,413,724 | 5/1995 | Kosal et al. | 252/8.6 |
| 5,494,554 | 2/1996 | Edwards et al. | 162/111 |
| 5,520,827 | 5/1996 | Danner | 252/8.6 |
| 5,529,665 | 6/1996 | Kaun | 162/111 |
| 5,538,595 | 7/1996 | Trokhan et al. | 162/123 |
| 5,562,761 | 10/1996 | Dirschl et al. | 252/8.62 |
| 5,567,347 | 10/1996 | Kosal et al. | 252/8.62 |
| 5,573,694 | 11/1996 | Danner | 252/8.63 |
| 5,582,674 | 12/1996 | Patterson et al. | 156/290 |
| 5,593,483 | 1/1997 | Brunken | 106/2 |
| 5,593,611 | 1/1997 | Czech | 252/8.63 |
| 5,626,571 | 5/1997 | Young et al. | 604/370 |
| 5,679,218 | 10/1997 | Vinson et al. | 162/109 |
| 5,814,188 | 9/1998 | Vinson et al. | 162/100 |

FOREIGN PATENT DOCUMENTS

| | | |
|---|---|---|
| WO 97/04171 A1 | 2/1997 | WIPO . |
| WO 97/41301 A1 | 11/1997 | WIPO . |
| WO 98/29605 A1 | 7/1998 | WIPO . |

OTHER PUBLICATIONS

"Magnasoft EPS Hydrophilic Softener Finish For Woven Substrates, Product Information," OSi Specialties, Inc., Danbury, Connecticut, 1994, 11 pgs.

"NuWet 550 Hydrophilic Silicone Finish, Durable Nonmigrating Finish for Nonwovens, Product Information," OSi Specialties, Inc., 1996, 6 pgs.

*Primary Examiner*—Margaret G. Moore
*Attorney, Agent, or Firm*—Gregory E. Croft

[57] ABSTRACT

Amine-modified polysiloxanes are applied to the opposite outer surfaces of a tissue product, such as the two outer surfaces of a 3-ply facial tissue, providing improved softness to the surfaces and a degree of hydrophobicity to prevent wet through of liquids during use. However, the degree of hydrophobicity is controlled by the chemical structure of the amine-modified polysiloxane and/or by blending the amine-modified polysiloxane with a more hydrophilic modified polysiloxane such that liquid is still allowed to enter the tissue structure in a reasonably short time to be absorbed by the center ply, but the absorption in combination with the hydrophobicity of the other outer surface substantially delays the liquid from passing completely through the tissue product.

14 Claims, 3 Drawing Sheets

SOFT ABSORBENT TISSUE PRODUCTS HAVING DELAYED MOISTURE PENETRATION

BACKGROUND OF THE INVENTION

In the manufacture of tissue products, including facial and bathroom tissues, the industry has applied considerable efforts to improve the tactile characteristics to meet the consumer's desire for "soft" tissues. There are two primary methods for improving the softness of tissues via chemical additives. First, there are chemicals softening agents that can be added to the furnish prior to the forming process to reduce the basesheet stiffness and/or deliver improved surface feel characteristics. Second, there are chemistries that can be applied to the tissue surface after the sheet has been formed to provide improved surface feel.

However, in addition to softness, another desirable attribute for both facial and bathroom tissue is the ability to keep the hand protected during use. Therefore, since both softness and hand protection are key consumer benefits for consumer tissue products, there is a need for a single chemistry system that can deliver both attributes.

SUMMARY OF THE INVENTION

It has now been discovered that topically treating multi-ply tissue basesheets with one or more suitable amine-modified polysiloxanes results in a softer tissue, via both improved surface feel and reduced basesheet stiffness mechanisms, with a controlled water repellency and absorbency sufficient to provide hand protection during use. The amine-modified polysiloxanes preferentially reside on the outer surface of the tissue plies to which the modified polysiloxanes are applied, either as a result of hydrogen bonding, charge attraction, or other chemical interaction, thereby providing a softness benefit on the surface and providing a degree of water or liquid repellency. However, when liquid does penetrate the outer surface of the tissue, the liquid is readily absorbed by the central, untreated portion of the tissue and is wicked away in the x-y plane of the tissue. At the same time, the presence of the amine-modified polysiloxane on the opposite surface delays further penetration of the liquid to the outside of the tissue, thus essentially trapping the liquid in the center of the tissue. This "one-way valve" effect protects the user's hands from becoming wet during normal use and, at the same time, provides a softness benefit. The combination of softness, liquid repellency and absorbency is unique and beneficial to consumers.

However, not all amine-modified polysiloxanes are suitable for purposes of this invention. It is necessary to impart the proper balance of hydrophilicity and hydrophobicity to the tissue surface in order to adequately delay liquid penetration, yet allow sufficient penetration to enable the inner portion of the tissue to absorb the liquid. The desired balance can be achieved by altering one or more of the following factors to increase or decrease hydrophobicity: (1) the molecular weight of the amine-modified polysiloxane can be increased to increase hydrophobicity and decreased to increase hydrophilicity; (2) the mole percent of the amine-functional groups within the amine-modified polysiloxane molecule can be changed to increase or decrease hydrophobicity; (3) the add-on amount of the amine-modified polysiloxane applied to the surface of the tissue can be increased to increase hydrophobicity; and (4) the amine-modified polysiloxane can be blended with a more hydrophilic material, such as a modified polysiloxane like a polyether-modified polysiloxane, to decrease hydrophobicity. By balancing these factors, those skilled in the chemical arts can achieve amine-modified polysiloxanes and blends of modified polysiloxanes that achieve the tissue properties of this invention.

Hence, in one aspect, the invention resides in a soft tissue product having two or more plies, said tissue product having an MD Modulus (hereinafter defined) of about 30 kilograms or less, a Wet Out Area (hereinafter defined) of about 2 square inches or greater, and a Wet Through Time (hereinafter defined) of about 15 seconds or greater. Such tissue products have the proper balance of softness (as measured by the MD Modulus) and absorbency (as measured by the Wet Through Time and the Wet Out Area) to keep the user's hands protected from liquids during use.

More specifically, the invention resides in a soft tissue product having two or more plies and two outwardly-facing surfaces topically treated with an amine-modified polysiloxane, said tissue product having an MD Modulus of about 30 kilograms or less, a Wet Out Area of about 2 square inches or greater, and a Wet Through Time of about 15 seconds or greater.

More specifically, the Wet Out Area can be about 3 square inches or greater, more specifically about 4 square inches or greater, and still more specifically from about 2 square inches to about 6 square inches. Also more specifically, the Wet Through Time can be about 20 seconds or greater, more specifically about 30 seconds or greater, more specifically about 45 seconds or greater, and still more specifically from about 15 to about 60 seconds. Also more specifically, the MD Modulus can be about 20 kilograms or less, still more specifically from about 5 to about 20 kilograms.

In another aspect, the invention resides in a method of making soft, controlled absorbency multi-ply tissue product comprising: a) forming an aqueous suspension of papermaking fibers; b) depositing the aqueous fiber suspension onto a forming fabric to form a web; c) drying the web to form a tissue sheet; d) combining the tissue sheet with one or more like tissue sheets to form a multi-ply tissue basesheet having two outer surfaces; and (e) topically treating both outer surfaces of the tissue surface with an aqueous emulsion of an amine-modified polysiloxane to form a tissue product, said tissue product having a Wet Out Area of about 2 square inches or greater and a Wet Through Time of about 15 seconds or greater.

As used herein, the "MD Modulus" is a measure of the softness of the tissue sheet and is the slope of the least squares straight line between the 70 and 157 gram points for the load vs. the percent elongation of the sample. MD Modulus values are obtained using conventional tensile testing instruments (e.g., Sintech/2 Computer integrated testing system). A single facial tissue is cut in the machine direction to a 3 inch width with a die cutter. The test sample length should exceed the gauge length (distance between the jaws of the tensile tester) by at least two inches. The test sample should not have any tears or creases and should have clean cut and parallel edges. The tensile tester jaws are opened and the test specimen is placed between the jaws, straight and centered. The jaws are closed on the specimen and the testing protocol is initiated. The specimen is pulled at ⅓ normal test speed (ten inches per minute). When the test load reaches 0.5% of the full scale load, the elongation is measured to correct for any slack in the test specimen. At that point, the crosshead changes speed and continues at the normal test speed. Data is collected until the peak load is reached and the load drops to 65% of the peak load. A suitable tensile tester can be obtained from Sintech Inc., P.O. Box 14226, Research Triangle Park, N.C. 27709-4226.

The means for determining "Wet Through Time" and "Wet Out Area" will be described in detail in connection with the Drawings.

Tissue products of this invention can have two-plies, three-plies, four plies or more. Three ply products are preferred because the two outer plies can each have their outwardly-facing surface treated with the modified polysiloxane(s) in accordance with this invention. The resulting three-ply product has two soft, liquid repellent outer surfaces and an inner absorbent ply. This allows liquid to not only be absorbed by the inner ply, but also to be entrapped in the space between the plies, which further reduces the likelihood of the user experiencing wet through of the tissue during use. Particularly suitable tissue products include facial tissue, bath tissue, kitchen towels and the like. These products are suitably made using conventional papermaking fibers. Their individual plies can be layered or homogeneous, wet-pressed or throughdried.

Amine-modified polysiloxane materials which are suitable for purposes of this invention have the following general formula:

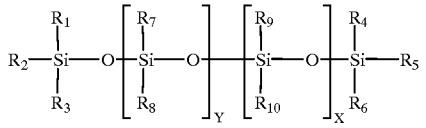

wherein x and y are integers >0. The mole ratio of x to (x+y) can be from 0.005 percent to about 25 percent. The $R_1$–$R_9$ moieties can be $C_1$ or greater alkyl substituents. Additionally, $R_2$ and $R_5$ can be hydroxyl or $C_1$ or greater alkyl alcohol substituents. Preferred $R_1$–$R_9$ moieties include $C_1$–$C_4$. The $R_{10}$ moiety can include any amine-related functional group or groups such as amine, imine, and/or amide.

For example, the amine-modified polysiloxane can be a polysiloxane where the $R_{10}$ moiety contains one amine group per substituent or two or more amine groups per substituent, separated by a linear or branched alkyl chain of $C_1$ or greater.

Modified polysiloxane materials which are suitable for blending or mixing with the amine-modified polysiloxane(s) for purposes of balancing the hydrophobicity in accordance with this invention have the following general formula:

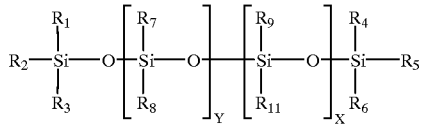

wherein x and y are integers >0. The mole ratio of x to (x+y) can be from 0.005 percent to about 25 percent. The $R_1$–$R_9$ moieties can be $C_1$ or greater alkyl substituents. Additionally, $R_2$ and $R_5$ can be hydroxyl or $C_1$ or greater alkyl alcohol substituents. Preferred $R_1$–$R_9$ moieties include $C_1$–$C_4$. The $R_{11}$ moiety can include organic functional groups such as ether, polyether, ester, amine, imine, amide, or other functional groups, including the alkyl and alkenyl analogues of such functional groups.

As an example, the $R_{11}$ moiety can be a polyether functional group of the generic form $—R_{12}—(R_{13}—O)_a—(R_{14}—O)_b—R_{15}$; wherein $R_{12}$, $R_{13}$ and $R_{14}$ are alkyl chains of $C_1$ or greater, $R_{15}$ can be Hydrogen or a $C_1$–$C_4$ alkyl group, and "a" and "b" can be integers of from 1–100, more specifically from 10–30.

The viscosity range of the amine-modified polysiloxane, which is indicative of the molecular weight, can be from about 25 centipoise to about 2,000,000 centipoise or higher, more specifically from about 100 to about 1,000,000 centipoise.

Suitable methods of applying the modified polysiloxane (s) to the surface of the tissue include spraying, printing and coating. Gravure printing is preferred because of the control it offers with respect to the amounts added to the tissue surface. The amount of modified polysiloxane(s) applied to the surface of the tissue will depend on the particular modified polysiloxane. However, suitable add-on amounts are from about 0.1 to about 5 weight percent based on the dry weight of the tissue product, more specifically from about 0.5 to about 3 weight percent, and still more specifically from about 0.7 to about 2 weight percent. It is preferable to first emulsify the modified polysiloxane(s) in water using the appropriate surfactant before applying the emulsion to the surface of the tissue. While the modified polysiloxane(s) preferentially resides on the surface of the tissue to which applied, polysiloxanes inherently migrate such that even the center ply of a three-ply tissue product may contain some of the silicone material. However, such amounts are much less than the amount on the outer surface of the tissue so that the center ply remains substantially hydrophilic and can wick and absorb liquid.

In order to further optimize and balance the softness, hand protection and absorbency benefits of the modified polysiloxane treatment, blends of two or more modified polysiloxane materials can be applied to the surface of the tissue. In one particular example, a blend of a hydrophobic amino-modified polysiloxane and a hydrophilic polyether-modified polysiloxane can be used to adjust the Wet Through Time of the finished tissue product. The ratio of the amino-modified polysiloxane to the polyether-modified polysiloxane can be from 100 percent to about 10 percent, more specifically from 100 percent to about 50 percent.

Those familiar with the polymer art will appreciate that the molecular weight (viscosity), the degree of substitution, the selected species for the various R groups and their chain lengths, the mole ratio of the "X" and "Y" components of a single modified polysiloxane species, and blending two or more modified polysiloxane species can be varied to affect the hydrophobicity of the modified polysiloxane to be applied to the surface of the tissue in order to achieve the desired Wet Through Times and Wet Out Areas accordance with this invention.

DETAILED DESCRIPTION OF THE DRAWINGS

Figure 1:
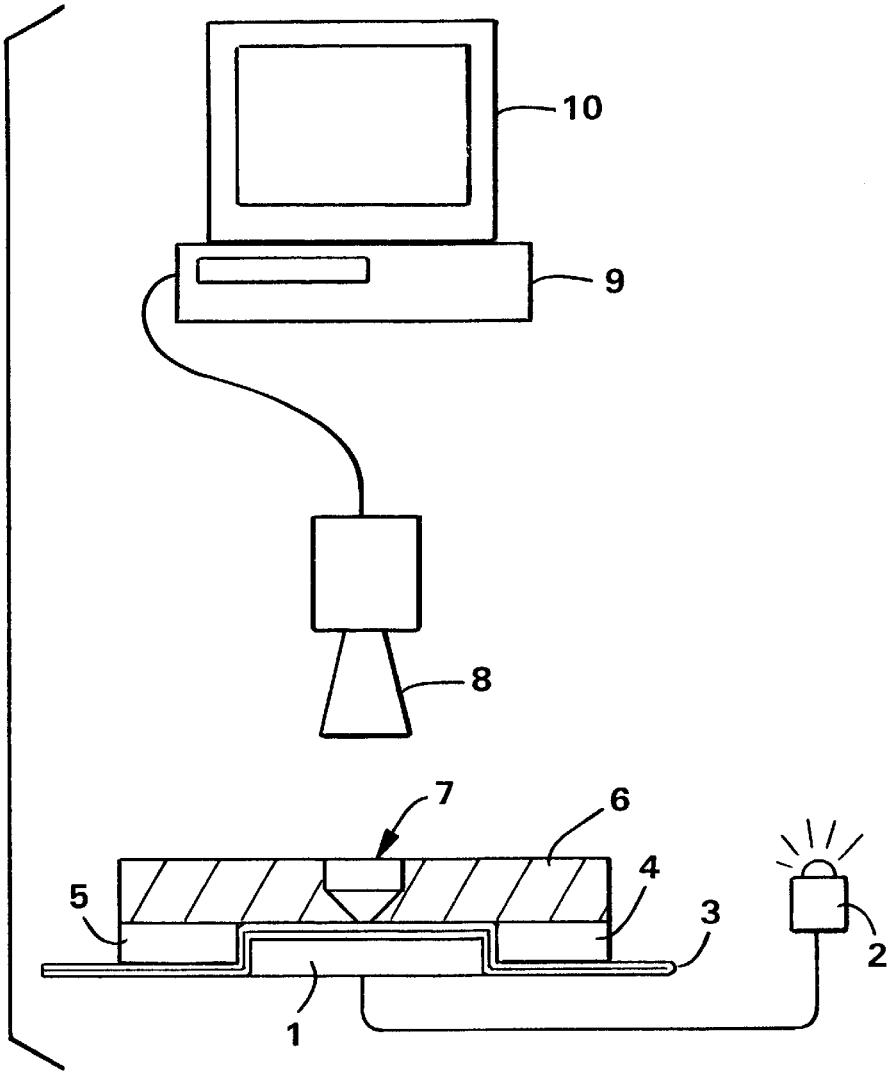
FIG. 1 is a schematic representation of the apparatus used to measure the Wet Through Time and the Wet Out Area as described herein.

Referring to the Drawings, the method for determining the Wet Through Time and the Wet Out Area will be described. In general, the method involves placing a measured amount of a dyed liquid on the top surface of a tissue sample and measuring the time it takes for the liquid to pass through the sample to activate a moisture sensor positioned on the bottom of the tissue. That time is the Wet Through Time. At that point in time, the extent to which the dyed liquid will have wicked in the x-y direction of the tissue will be visible as a circular or elliptical spot. The area of the spot is the Wet Out Area.

Figure 2:
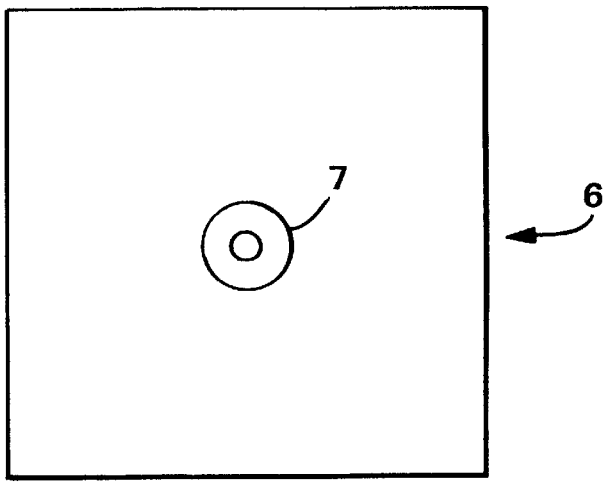
FIG. 2 is a plan view of the sample cover illustrated in FIG. 1.

FIG. 1 schematically illustrates the equipment set-up for carrying out the test procedure. Shown is a moisture sensor 1 which rests on a flat surface and is connected to a moisture light indicator 2. (The specific moisture sensor is a Cole-Parmer Liqui-Sense Controller 77096-00 manufactured by Barnant Company, Barrington, Ill., with a Cole-Parmer Liqui-Sense Sensor 77095-00. The sensitivity of the moisture sensor is calibrated to respond to 0.2 milliliter of the test liquid (described below) per the manufacturer's instructions. The tissue sample 3, which has been folded in half and placed on top of the moisture sensor, is secured with two Lexan side weights 4 and 5 placed on both sides of the moisture sensor. Each side weight measures ¾ inch by ¼ inch in cross-section and is 4 inches long. These weights are placed such that the folded tissue sample rests flat against the surface of the moisture sensor, but is not under tension. On top of the sample is placed a 4 inches by 4 inches by ½ inch Lexan sample cover 6 as further illustrated in FIG. 2. The sample cover has a conical hole 7 through the center measuring ⅜ inch in diameter on the top surface and 1/16 inch in diameter at the bottom surface. Because the thickness of the moisture sensor is slightly less than the ¼ inch thickness of the side weights, the sample holder primarily rests on the side weights.

Positioned above the sample cover is a video camera 8 (JVC TK-1070U Color Video Camera made in Japan by JVC). The video camera output is connected to a video cassette recorder 9 (Panasonic AG-1 960 Proline distributed by Panasonic Industrial Co., Secaucus, N.J.) and a color monitor 10 (Panasonic CT-1 381-Y Color Video Monitor). The video camera is positioned on a tripod such that the moisture light indicator 2 is visible within the view of the video camera.

The test liquid used to conduct the testing is Hercules Size Tester Green Dye, available from Hercules Incorporated, Wilmington, Del. The test liquid has the following properties measured at 22° C.: viscosity of 10 centipoise when measured using a Brookfield Synchro-lectric Viscometer model RVT with spindle No. 1 at a speed of 50 rpm; surface tension of 60.5 dynes per centimeter when measured using a duNouy ring tensiometer (Fisher Scientific Surface Tensiometer 20); pH of 7.3; and a specific conductance of 18 micro Siemens per centimeter.

To carry out the testing to determine the Wet Through Time and the Wet Out Area, the video picture is adjusted so that the picture of the sample cover measures 6 inches by 6 inches on the video monitor. The Liqui-Sense controller unit is positioned such that the alarm light (moisture indicator light) can be clearly seen on the video screen. A sample of the tissue product to be tested is folded in half, placed over the moisture sensor, secured with the side weights, and covered with the sample cover as previously shown and described. The video cassette recorder (VCR) is started. Using a micro-pipette, 0.5 milliliter of the test liquid is placed in the hole 5 of the sample cover and timing of the test is begun. When the moisture monitor alarm light is activated, the elapsed time in seconds is the Wet Through Time for that sample. After that point the VCR is stopped. Using the video jog and pause features, the video image is adjusted to the frame where the alarm was activated, showing the size of the spot created by the dyed test liquid. The area of the dye image on the video screen at that point in time, expressed in square inches, is the Wet Out Area. Because the shape of the dye images is generally elliptical, the area can readily be determined by measuring the major and minor axis of the ellipse and calculating the area. However, if greater precision is desired, it will be appreciated that it is also possible to calculate the area using more sophisticated image analysis techniques.

Figure 3:
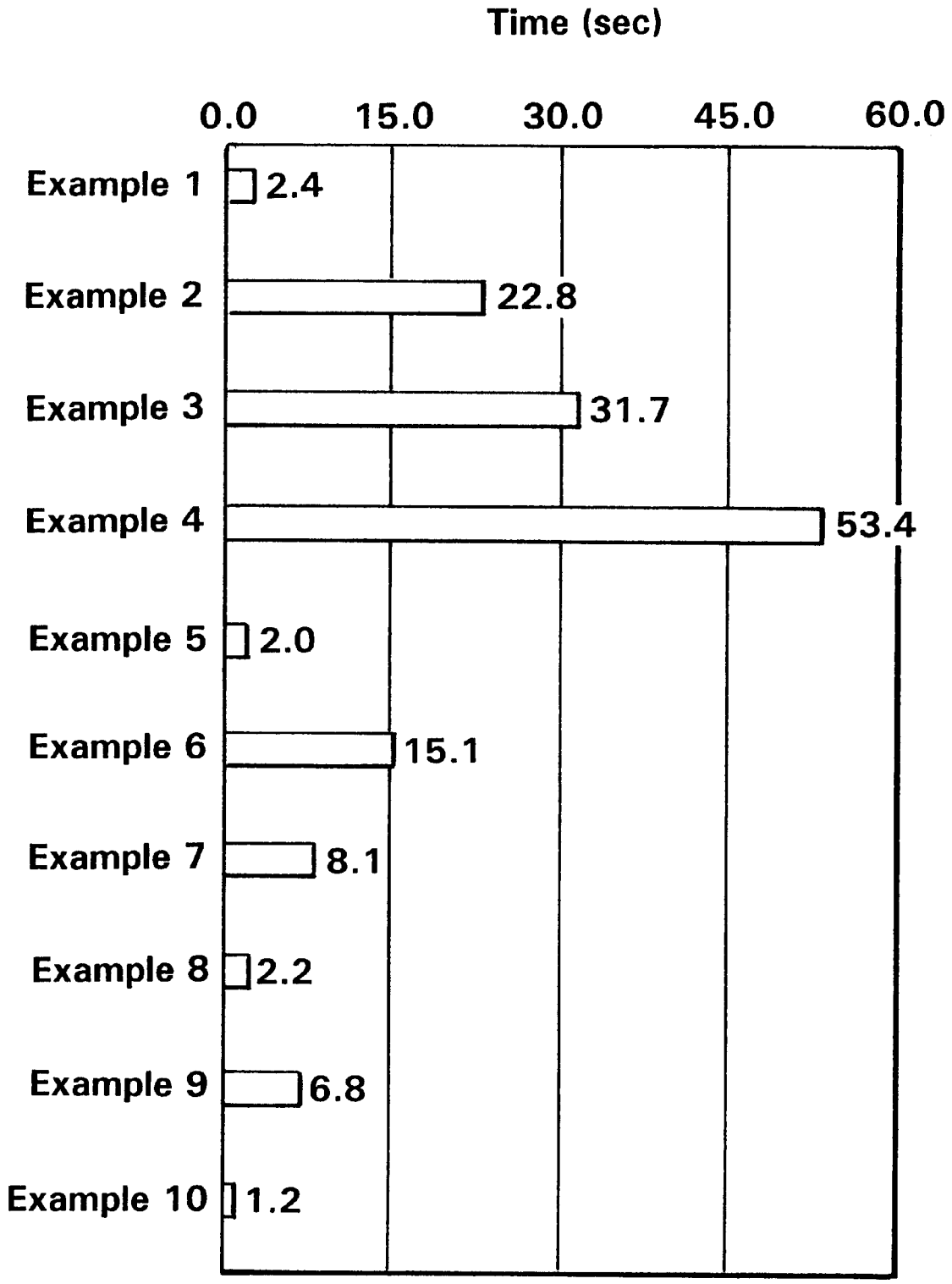
FIG. 3 is a bar chart illustrating the Wet Through Time for tissues of this invention as compared to certain other tissues.
Figure 4:
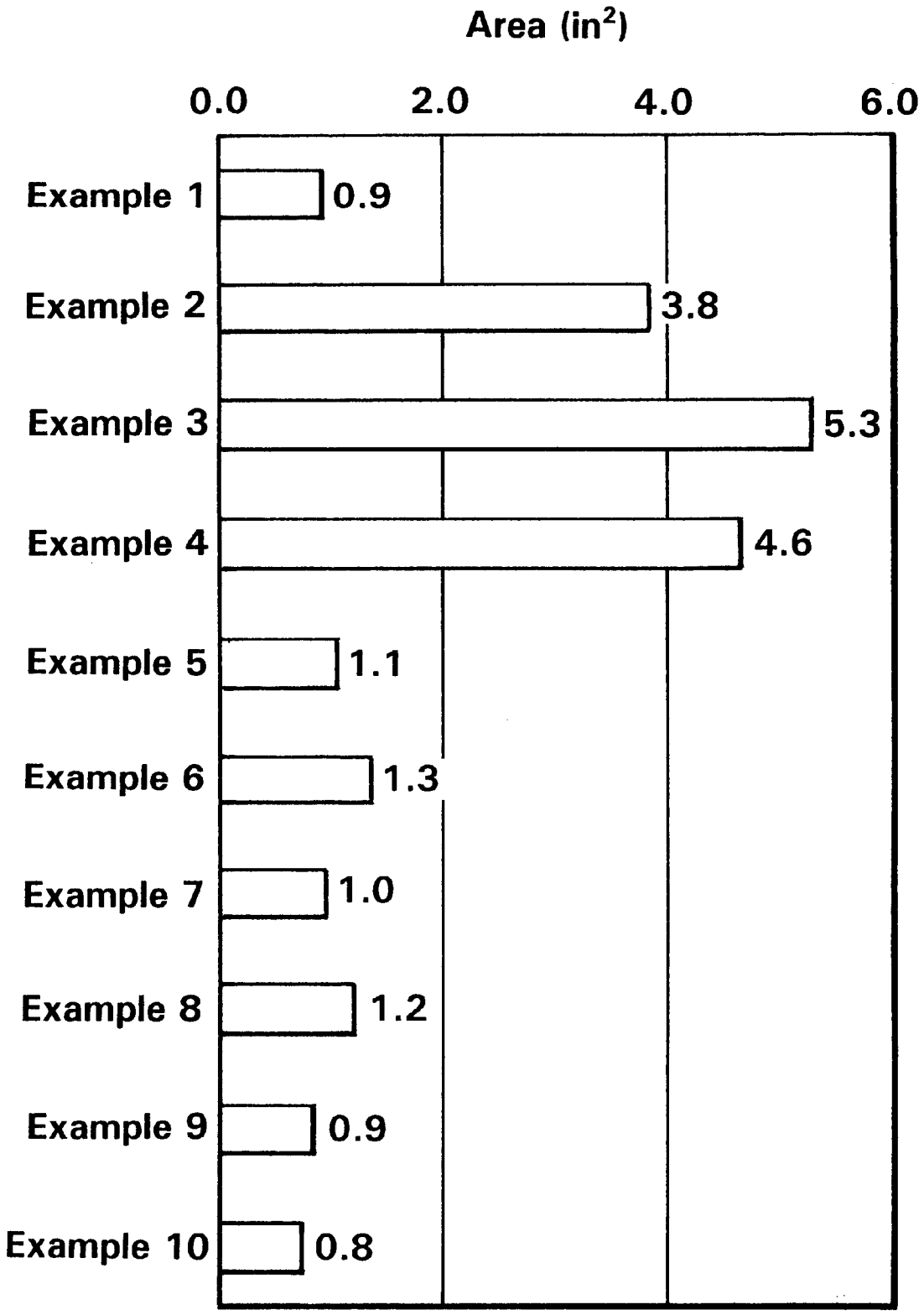
FIG. 4 is a bar chart illustrating the Wet Out Area for tissues of this invention as compared to the other tissues of FIG. 3.

FIGS. 3 and 4 are bar charts illustrating the Wet Through Time and Wet Out Area for tissues made by the following Examples and several commercial tissues. As shown, the tissues of this invention have a unique combination of high water repellency (as measured by relatively high values for the Wet Through Time) and high absorbency (as measured by the relatively high values for the Wet Out Area.)

EXAMPLES

Example 1

Control

A three ply tissue web having a finished basis weight of 22.7 pounds per 2880 square feet and a furnish consisting of 65 percent hardwood and 35 percent softwood fibers, was printed on two sides with a modified polysiloxane aqueous emulsion (FTS-226 manufactured by Witco Corporation, Greenwich, Conn.) via a simultaneous rotogravure printing process. The modified polysiloxane aqueous emulsion contained about 20 weight percent of an amino-modified polysiloxane, about 20 weight percent of a polyether-modified polysiloxane, about 57 weight percent water, about 2 weight percent emulsifiers, about 0.75 weight percent of a biocide package and a small amount of a buffering agent to adjust the pH of the final emulsion to within the range of 6.5–7.5. The ratio of the percent amino-modified polysiloxane to the percent polyether-modified polysiloxane was 50/50.

The gravure rolls were electronically engraved, chrome over copper rolls supplied by Southern Graphics Systems, Louisville, Ky. The rolls had a line screen of 360 cells per lineal inch and a volume of 1.5 Billion Cubic Microns (BCM) per square inch of roll surface. Typical cell dimensions for this roll were 65 microns in length, 110 microns in width, and 13 microns in depth. The rubber backing offset applicator rolls were a 75 Shore A durometer cast polyurethane supplied by American Roller Company, Union Grove, Wis. The process was set up to a condition having 0.375 inch interference between the gravure rolls and the rubber backing rolls and 0.003 inch clearance between the facing rubber backing rolls. The simultaneous offset/offset gravure printer was run at a speed of 2000 feet per minute. This process yielded an add-on level of 1.0 weight percent total add-on based on the weight of the tissue.

The resulting soft tissue product had a Wet Through Time of 2.4 seconds and a Wet Out Area of 0.9 square inches. The MD Modulus was about 16.54 kilograms.

Example 2

This Invention

A tissue product was prepared as described in Example 1, except the modified polysiloxane aqueous emulsion (Y-14344 silicone emulsion from Witco Corporation) was a 1:1 mixture by weight of a first modified polysiloxane aqueous emulsion (Y-14264 silicone emulsion from Witco Corporation) and a second modified polysiloxane aqueous emulsion (Y-14275 silicone emulsion from Witco Corporation). More specifically, the first modified polysiloxane aqueous emulsion contained about 32 weight percent of an amino-modified polysiloxane, about 63.2 weight percent water, about 3.2 weight percent of an emulsifier package, about 0.75 weight percent of a biocide package, about 0.8 weight percent of a freeze-thaw stabilizer and a buffering agent to bring the pH to within the range of 6.5–7.5. The second modified polysiloxane aqueous emulsion contained about 24 weight percent of an amino-modified polysiloxane, about 11 weight percent of a blend of two polyether-modified polysiloxanes, about 61.2 weight percent water, about 2.4 weight percent of an emulsifier package, about 0.75 weight percent of a biocide package, about 0.6 weight percent of a freeze-thaw stabilizer and sufficient buffering agent to bring the pH to within 6.5–7.5. The ratio of the percent amino-modified polysiloxane to the percent polyether-modified polysiloxane was 84/16.

The resulting soft tissue product had a Wet Through Time of 22.8 seconds and a Wet Out Area of 3.8 square inches. The MD Modulus was 14.18 kilograms.

Example 3

This Invention

A tissue product was prepared as described in Example 1, except the modified polysiloxane aqueous emulsion (Y-14316 silicone emulsion from Witco Corporation) was a 9:1 mixture by weight of a first modified polysiloxane aqueous emulsion (Y-14264 silicone emulsion from Witco Corporation) and a second modified polysiloxane aqueous emulsion (Y-14275 silicone emulsion from Witco Corporation). More specifically, the first modified polysiloxane aqueous emulsion contained about 32 weight percent of an amino-modified polysiloxane, about 63.2 weight percent water, about 3.2 weight percent of an emulsifier package, about 0.75 weight percent of a biocide package, about 0.8 weight percent of a freeze-thaw stabilizer and a buffering agent to bring the pH to within the range of 6.5–7.5. The second modified polysiloxane aqueous emulsion contained about 24 weight percent of an amino-modified polysiloxane, about 11 weight percent of a blend of two polyether-modified polysiloxanes, about 61.2 weight percent water, about 2.4 weight percent of an emulsifier package, about 0.75 weight percent of a biocide package, about 0.6 weight percent of a freeze-thaw stabilizer and sufficient buffering agent to bring the pH to within 6.5–7.5. The ratio of the percent amino-modified polysiloxane to the percent polyether-modified polysiloxane was 97/3.

The resulting soft tissue product had a Wet Through Time of 31.7 seconds and a Wet Out Area of 5.3 square inches. The MD Modulus was 17.24 kilograms.

Example 4

This Invention

A tissue product was prepared as described in Example 1, except the modified polysiloxane aqueous emulsion contained about 32 weight percent of an amino-modified polysiloxane, about 63.8 weight percent water, about 3.2 weight percent of an emulsifier package, about 0.2 weight percent of a biocide package and about 0.8 weight percent of a freeze-thaw stabilizer. (Y-14240 silicone emulsion from Witco Corporation). The ratio of the percent amino-modified polysiloxane to the percent polyether-modified polysiloxane was 100/0.

The resulting soft tissue product had a Wet Through Time of 53.4 seconds and a Wet Out Area of 4.6 square inches. The MD Modulus was 11.65 kilograms.

Example 5

Commercial Tissue

A sample of Kleenex® facial tissue (Kimberly-Clark Corporation) was tested as described above. The tissue had a Wet Through Time of 2.0 seconds and a Wet Out Area of 1.1 square inches.

Example 6

Commercial Tissue

A sample of Kleenex® Cold Care® with Lotion facial tissue (3-ply) was tested as described above. The tissue had a Wet Through Time of 15.1 seconds and a Wet Out Area of 1.3 square inches.

Example 7

Commercial Tissue

A sample of Puffs® Soft and Strong facial tissue was tested as described above. The tissue had a Wet Through Time of 8.1 seconds and a Wet Out Area of 1.0 square inch.

Example 8

Commercial Tissue

A sample of Puffs® Advanced Extra Strength facial tissue was tested as described above. The tissue had a Wet Through Time of 2.2 seconds and a Wet Out Area of 1.2 square inches.

Example 9

Commercial Tissue

A sample of Puffs Plus® facial tissue was tested as described above. The tissue had a Wet Through Time of 6.8 seconds and a Wet Out Area of 0.9 square inch.

Example 10

Commercial Tissue

A sample of Scotties® facial tissue (3-ply) was tested as described above. The tissue had a Wet Through Time of 1.2 seconds and a Wet Out Area of 0.8 square inch.

It will be appreciated that the foregoing examples, given for purposes of illustration, are not to be construed as limiting the scope of this invention, which is defined by the following claims and all equivalents thereto.

We claim:

1. A soft tissue product having two or more plies, said tissue product having an MD Modulus of about 30 kilograms or less, a Wet Out Area of about 2 square inches or greater, and a Wet Through Time of about 15 seconds or greater.

2. The tissue product of claim 1 further comprising a center ply.

3. The tissue product of claim 1 wherein the Wet Out Area is about 3 square inches or greater.

4. The tissue product of claim 1 wherein the Wet Out Area is about 4 square inches or greater.

5. The tissue product of claim 1 wherein the Wet Out Area is from about 2 to about 6 square inches.

6. The tissue product of claim 1 wherein the Wet Through Time is about 20 seconds or greater.

7. The tissue product of claim 1 wherein the Wet Through Time is about 30 seconds or greater.

8. The tissue product of claim 1 wherein the Wet Through Time is about 45 seconds or greater.

9. The tissue product of claim 1 wherein the Wet Through Time is from about 15 to about 60 seconds.

10. A soft tissue product having two or more plies and two outwardly-facing surfaces topically treated with an amine-modified polysiloxane, said tissue product having an MD Modulus of about 30 kilograms or less, a Wet Out Area of about 2 square inches or greater, and a Wet Through Time of about 15 seconds or greater, wherein the amine-modified polysiloxane has the following general formula:

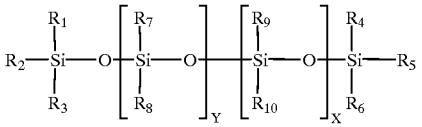

wherein x and y are integers >0;

the mole ratio of x to (x+y) is from 0.005 percent to about 25 percent;

$R_1$, $R_3$, $R_4$, and $R_6$–$R_9$ are $C_1$ or greater alkyl substituents;

$R_2$ and $R_5$ are $C_1$ or greater alkyl, $C_1$ or greater alkyl alcohol, or hydroxyl substituents; and $R_{10}$ is an alkyl chain of $C_1$ or greater comprising one or more functional groups selected from the group consisting of amine, imine, and/or amide.

11. The tissue product of claim 10 wherein $R_{10}$ comprises one or more amine groups separated by a alkyl chain of $C_1$ or greater.

12. The tissue product of claim 10 wherein the amine-modified polysiloxane is blended with another modified polysiloxane of the formula:

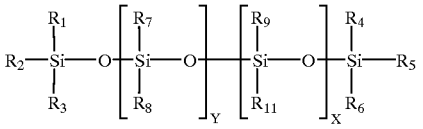

wherein x and y are integers >0;

the mole ratio of x to (x+y) is from 0.005 percent to about 25 percent;

$R_1$, $R_3$, $R_4$, and $R_6$–$R_9$ are $C_1$ or greater alkyl substituents;

$R_2$ and $R_5$ are $C_1$ or greater alkyl, $C_1$ or greater alkyl alcohol, or hydroxyl substituents; and $R_{11}$ is an alkyl chain of $C_1$ or greater comprising one or more functional groups selected from the group consisting of ether, polyether, ester, amine, imine, amide, and the alkyl and alkenyl analogues of such functional groups.

13. The tissue product of claim 12 wherein $R_{11}$ is of the general formula: $—R_{12}—(R_{13}—O)_a—(R_{14}—O)_b—R_{15}$; wherein $R_{12}$, $R_{13}$ and $R_{14}$ are alkyl chains of $C_1$ or greater, $R_{15}$ is hydrogen or a $C_1$–$C_4$ alkyl group, and "a" and "b" are integers of from 1–100.

14. A method of making soft, controlled absorbency multi-ply tissue product comprising: a) forming an aqueous suspension of papermaking fibers; b) depositing the aqueous fiber suspension onto a forming fabric to form a web; c) drying the web to form a tissue sheet; d) combining the tissue sheet with one or more like tissue sheets to form a multi-ply tissue basesheet having two outer surfaces; and (e) topically treating both outer surfaces of the tissue surface with an aqueous emulsion of an amine-modified polysiloxane to form a tissue product, said tissue product having a Wet Out Area of about 2 square inches or greater and a Wet Through Time of about 15 seconds or greater.

* * * * *